US011952928B2

(12) United States Patent
Thomassik et al.

(10) Patent No.: US 11,952,928 B2
(45) Date of Patent: Apr. 9, 2024

(54) EXHAUST SYSTEM FOR A WORK VEHICLE

(71) Applicant: DEERE & COMPANY, Moline, IL (US)

(72) Inventors: Thorsten Thomassik, Mannheim (DE); Peter Kuegler, Frankenthal (DE); Robert Kuczkowski, Kirchheimbolanden (DE); Sathish Thirumalai, Chennai (IN); Johanna Faltin, Lambsheim (DE)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 18/161,111

(22) Filed: Jan. 30, 2023

(65) Prior Publication Data

US 2023/0313726 A1 Oct. 5, 2023

(30) Foreign Application Priority Data

Mar. 31, 2022 (DE) ..... 102022107706.3

(51) Int. Cl.
*F01N 13/14* (2010.01)
*F01N 13/00* (2010.01)
*F01N 13/18* (2010.01)

(52) U.S. Cl.
CPC ..... *F01N 13/14* (2013.01); *F01N 13/008* (2013.01); *F01N 13/141* (2013.01); *F01N 13/143* (2013.01); *F01N 13/1811* (2013.01); *F01N 13/1816* (2013.01); *F01N 2260/20* (2013.01); *F01N 2560/026* (2013.01)

(58) Field of Classification Search
None
See application file for complete search history.

(56) References Cited

U.S. PATENT DOCUMENTS 4,487,289 A * 12/1984 Kicinski ..... F01N 3/05 181/263
5,340,952 A * 8/1994 Takiguchi ..... F01N 13/18 181/282
2005/0023076 A1* 2/2005 Huff ..... F01N 13/1888 181/246
2007/0240932 A1* 10/2007 Van De Flier ..... F01N 1/24 181/228
2015/0167528 A1 6/2015 Pamanes et al.

FOREIGN PATENT DOCUMENTS

DE 102011003498 A1 3/2012
JP 6707489 B2 6/2020

OTHER PUBLICATIONS

European Search Report issued in application No. 23160525.4, dated Jul. 6, 2023, 04 pages.

* cited by examiner

*Primary Examiner* — Audrey B. Walter

(57) ABSTRACT

An exhaust system with a multipiece heat shield for a work vehicle includes a first shield part and a second shield part. The first shield part surrounds an aftertreatment unit for aftertreating exhaust gases. The first shield part extends in an axial direction. The second shield part surrounds an exhaust tailpipe with radial spacing between the second shield part and the exhaust tailpipe. The second shield extends in the axial direction from the first shield part, wherein a radial gap between the first and second shield parts is sealed by a seal.

16 Claims, 6 Drawing Sheets

EXHAUST SYSTEM FOR A WORK VEHICLE

CROSS-REFERENCE TO RELATED APPLICATIONS

This application claims priority to German Patent Application No. 102022107706.3, filed Mar. 31, 2022, which is hereby incorporated by reference.

FIELD OF THE DISCLOSURE

The disclosure concerns an exhaust system with a multipiece heat shield for a work vehicle.

BACKGROUND

Work vehicles can have exhaust systems with multipiece heat shields.

SUMMARY

In some work vehicles, a first shield part surrounds an aftertreatment unit for aftertreating exhaust gases, while a further shield part surrounds an exhaust tailpipe of the exhaust system. Crop residue may collect in the transitional region between the shield parts and affect the function of the heat shield.

It is therefore an object of the present disclosure to provide the heat shield with improved protection against undesirable influences. This object is achieved by an exhaust system having the features of one or more of the following embodiments. Additional benefits and features of the exhaust system are disclosed herein.

According to an embodiment, an exhaust system for a work vehicle, such as an agricultural tractor, comprises a multipiece heat shield. In an axial direction, the heat shield comprises at least a first shield part and a second shield part. The first shield part surrounds an aftertreatment unit for aftertreating exhaust gases from the work vehicle.

The second shield part surrounds an exhaust tailpipe of the exhaust system with radial spacing. A radial gap is formed between the two above-mentioned shield parts and is sealed by a seal.

The seal effectively prevents crop residue or other particles from being able to penetrate into a region inside the heat shield. Accordingly, crop residue and other foreign bodies also cannot collect in the transitional region between the two shield parts. Thus, an undesirable influencing of the heat shield (e.g., temperature rise, mechanical deformation) is reliably avoided.

Individual components of the heat shield or shield parts may be made from different materials. For example, the first and/or second shield parts are made from a plastic.

The aftertreatment unit can be a catalytic converter for aftertreatment of exhaust gases from diesel engines, for example an SCR (Selective Catalytic Reduction) catalyst. The aftertreatment unit reduces the emission of harmful constituents of the exhaust gas. For example, the emitted nitrogen oxides ($NO_x$) are reduced by selective catalytic reduction (SCR system).

In some embodiments, the seal is made of an elastic material in order to support a stable sealing function. For example, the seal can be made from silicone. This promotes a long service life and resistance of the seal, even if the seal is exposed to great temperature fluctuations in the region of the exhaust system and to other substances such as oil and/or fuel.

In some embodiments, the heat shield is configured such that the radial gap is formed between an opening of the first shield part and an opening of the second shield part. This promotes a simple design of the seal and its stable positioning on the heat shield. In some embodiments, the two openings are of different sizes. In the axial direction of the exhaust tailpipe, the two openings may lie in the same plane or in different planes, depending on the design of the heat shield.

In some embodiments, the opening of the first shield part is larger than the opening of the second shield part. With this design, in the case of successive mounting of the two shield parts, the seal can easily be pre-mounted in the region of the opening of the first shield part before the second shield part is mounted and positioned on the exhaust tailpipe.

In some embodiments, the seal has a movable and for example elastic sealing lip which delimits an axial seal opening for receiving the second shield part. Here, the seal is dimensioned such that in a starting position, the seal opening is smaller than a cross-section of an outer wall of the second shield part. During assembly, the second shield part is inserted in the seal opening, which (because of the elastic properties of the seal) leads to the seal automatically assuming a sealing position in which the sealing lip lies against the outer wall of the second shield part. This mounting leads to a self-locking of the seal on the heat shield without additional fixing means, specific tools and/or additional mounting steps.

In some embodiments, the seal is configured as a closed ring seal. This supports a simple mounting of the seal, and facilitates an even, stable sealing effect in the circumferential direction of the heat shield.

In some embodiments, in a starting position, the seal has two free ends arranged in the circumferential direction of the heat shield, which are arranged adjoining or overlapping one another in the circumferential direction when the seal is in a sealing position. In this way, the seal can be positioned on the heat shield very easily, in the manner of a sleeve. A mechanically stable seat of the sleeve-like seal on the shield may be further supported if the two above-mentioned free ends of the seal are fixed to one another by suitable fixing means (e.g., releasable locking elements, hook and loop tape strips).

In some embodiments, a mechanically stable positioning of the seal on the heat shield is supported if, along the circumferential direction of the heat shield, the seal has at least one fixing protrusion which cooperates with a fixing recess on the first shield part or on the second shield part. For example, several fixing protrusions are distributed along the circumferential direction of the seal. The seal may also be fixed to at least one fixing recess of the first shield part and at least one fixing recess of the second shield part by correspondingly arranged fixing protrusions.

In some embodiments, a defined sealing position of the seal can be achieved in technically simple fashion if the seal has a circumferential groove running in the circumferential direction of the heat shield and open axially towards the second shield part, for example a ring groove running in the circumferential direction. During mounting of the exhaust system, this seal may be positioned on the first shield part and then automatically receive an axial free end of the second shield part when the latter is mounted, since this surrounds the exhaust tailpipe and is moved axially in the direction of the seal.

In some embodiments, the seal has a radial passage opening for receiving a sensor unit. In this way, a sensor functionality of the exhaust system can be considered with no disadvantages with respect to structure and/or seal. Also, if necessary, the seal may be dimensioned such that it achieves an effective seal of the sensor unit on the exhaust system with no additional complexity.

In some embodiments, the sensor unit is a $NO_x$ sensor unit, which can be necessary in connection with exhaust aftertreatment and is positioned inside the exhaust system.

In some embodiments, the exhaust system according to the disclosure is used on diesel engines of work vehicles. In this way, the exhaust gas aftertreatment of work vehicles can be efficiently improved.

The above and other features will become apparent from the following detailed description and accompanying drawings.

BRIEF DESCRIPTION OF THE DRAWINGS

The exhaust system according to the disclosure is explained in more detail below with reference to the appended drawings. Components of comparable or corresponding function are marked with the same reference signs. In the drawings.

DETAILED DESCRIPTION

The embodiments or implementations disclosed in the above drawings and the following detailed description are not intended to be exhaustive or to limit the present disclosure to these embodiments or implementations.

Figure 1:
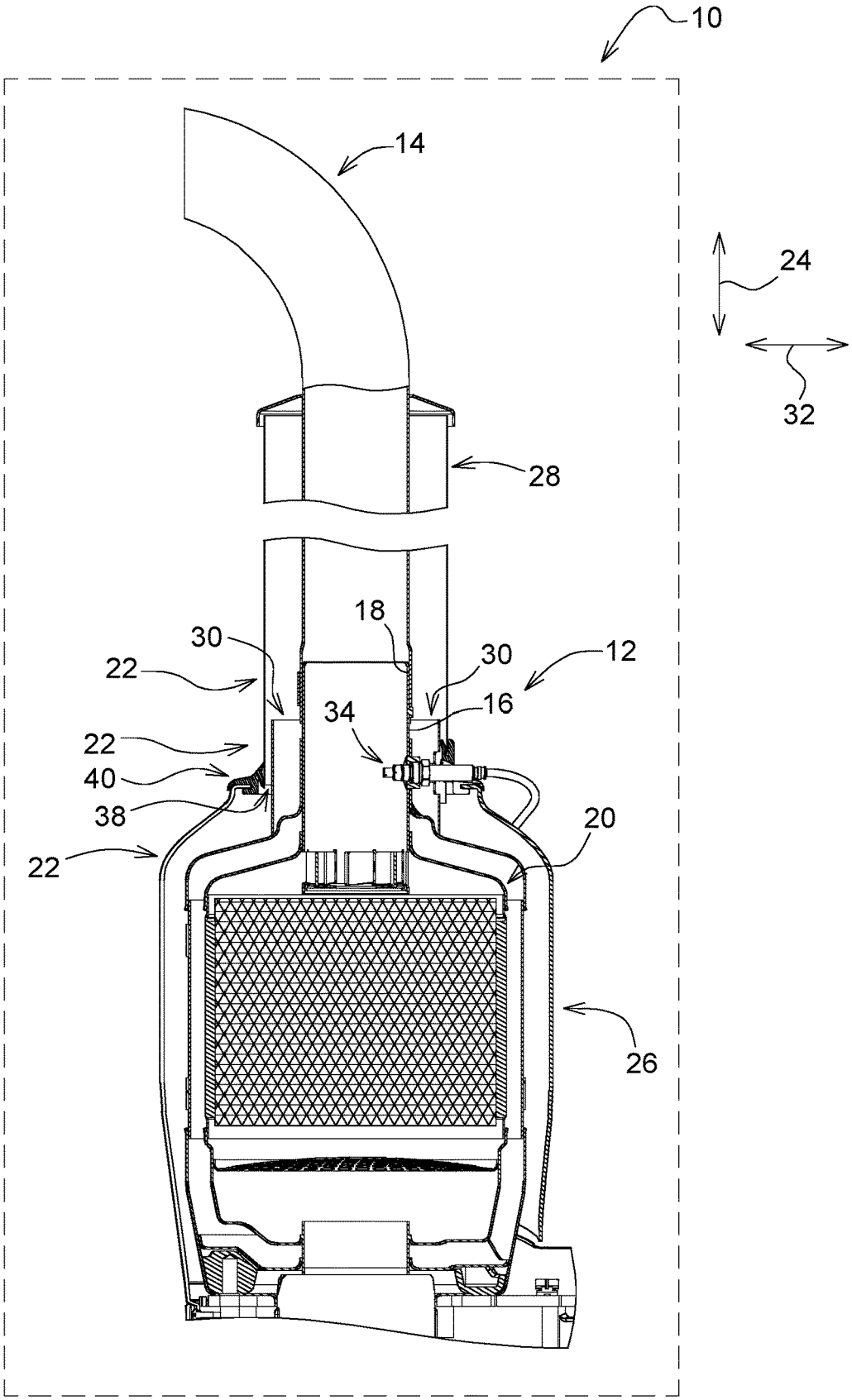
FIG. 1 shows a schematic side view of components of an exhaust system according to the disclosure for a work vehicle.

FIG. 1 shows schematically a work vehicle 10, such as an agricultural tractor, with components of an exhaust system 12. The exhaust system 12 comprises an exhaust tailpipe 14, the axial end portion 16 of which is fluidically connected to an outlet pipe 18 of an aftertreatment unit 20.

The aftertreatment unit 20 serves for aftertreatment of the exhaust gases of an internal combustion engine or diesel engine (not shown here) of the work vehicle 10. The aftertreatment unit 20 comprises for example an SCR system or SCR catalyst, via which the emitted nitrogen oxides ($NO_x$) are reduced by selective catalytic reduction (SCR).

The illustrated components of the exhaust system 12 are surrounded by a multipiece heat shield 22. The shield 22 is constructed in multiple pieces, wherein the parts 26, 28, 30 in an axial direction 24 are shown. Piece or part 26 designates a first shield part which is configured in the manner of a container and surrounds the aftertreatment unit 20. Piece or part 28 designates a second shield part which is configured as a pipe and surrounds the exhaust tailpipe 14 with a radial spacing. The radial spacing runs in a radial direction 32. Piece or part 30 designates a further shield part which is configured as a pipe and, with a radial spacing, surrounds the outlet pipe 18 or an axial transitional region between the aftertreatment unit 20 and exhaust tailpipe 14. The further shield part 30 is in turn surrounded by the second shield part 28 with radial spacing.

Axially in the region of the further shield part 30, the exhaust system 12 has a $NO_x$ sensor 34 which punctures the outlet pipe 18. The $NO_x$ sensor 34 is connected via a connecting line 36 to a control unit (not shown here), which for example determines the nitrogen oxide content in the exhaust gas, monitors the efficiency of the aftertreatment unit 20 and detects any malfunctions.

A radial gap 38 is formed between the two shield parts 26, 28 and is sealed by a seal 40. In this way, particles such as crop residue or other foreign bodies can be reliably prevented from undesirably penetrating into regions of the exhaust system 12.

Figure 2:
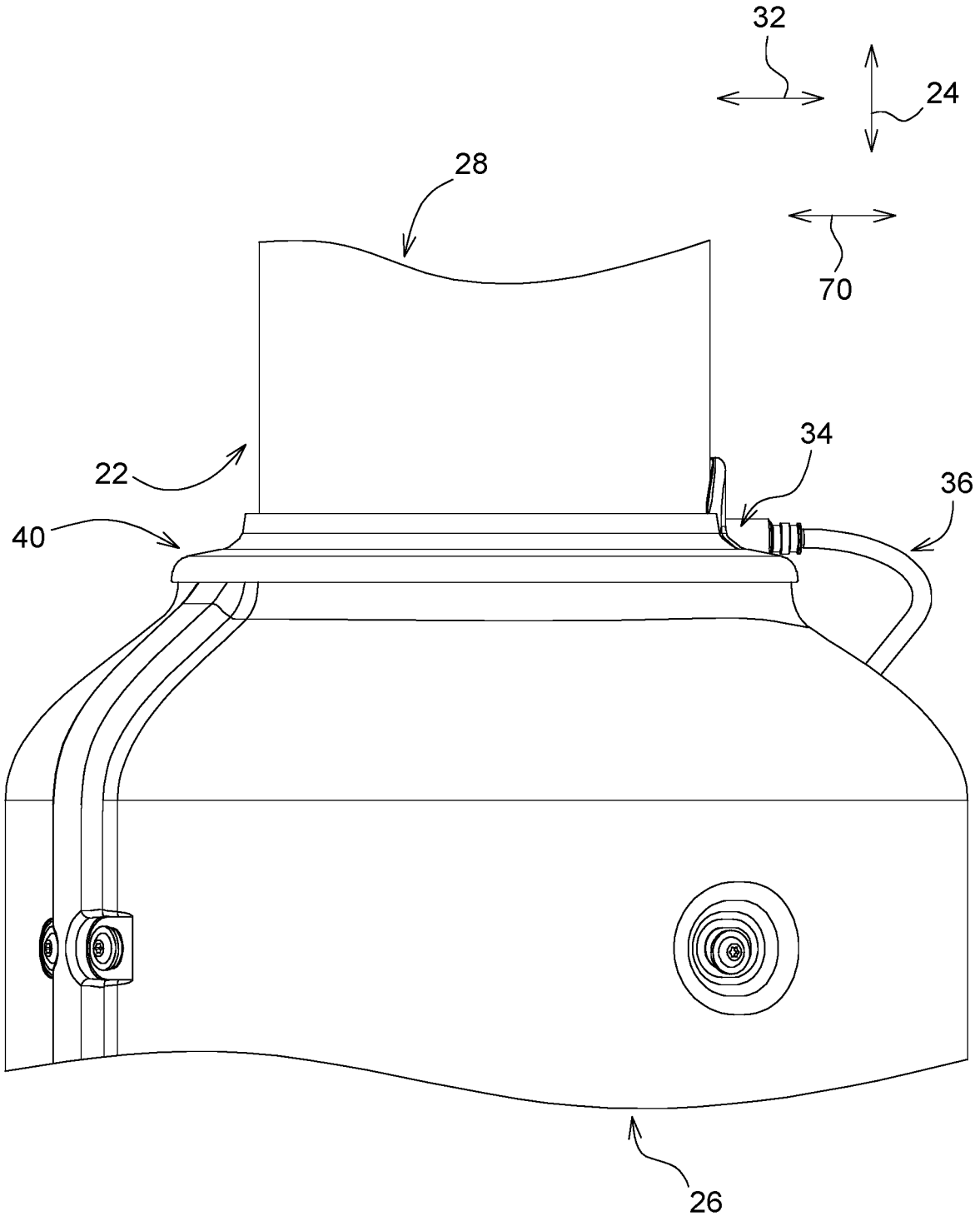
FIG. 2 shows a side view of components of the exhaust system according to the disclosure with a seal in a first embodiment.

The two shield parts 26, 28 can be approximately cylindrical or rotationally symmetrical components, as illustrated for example in FIG. 2. The radial gap 38 then forms a ring gap in a circumferential direction 70 of the heat shield 22, which gap may be sealed by a seal 40 configured as a closed ring seal (FIG. 3).

Figure 3:
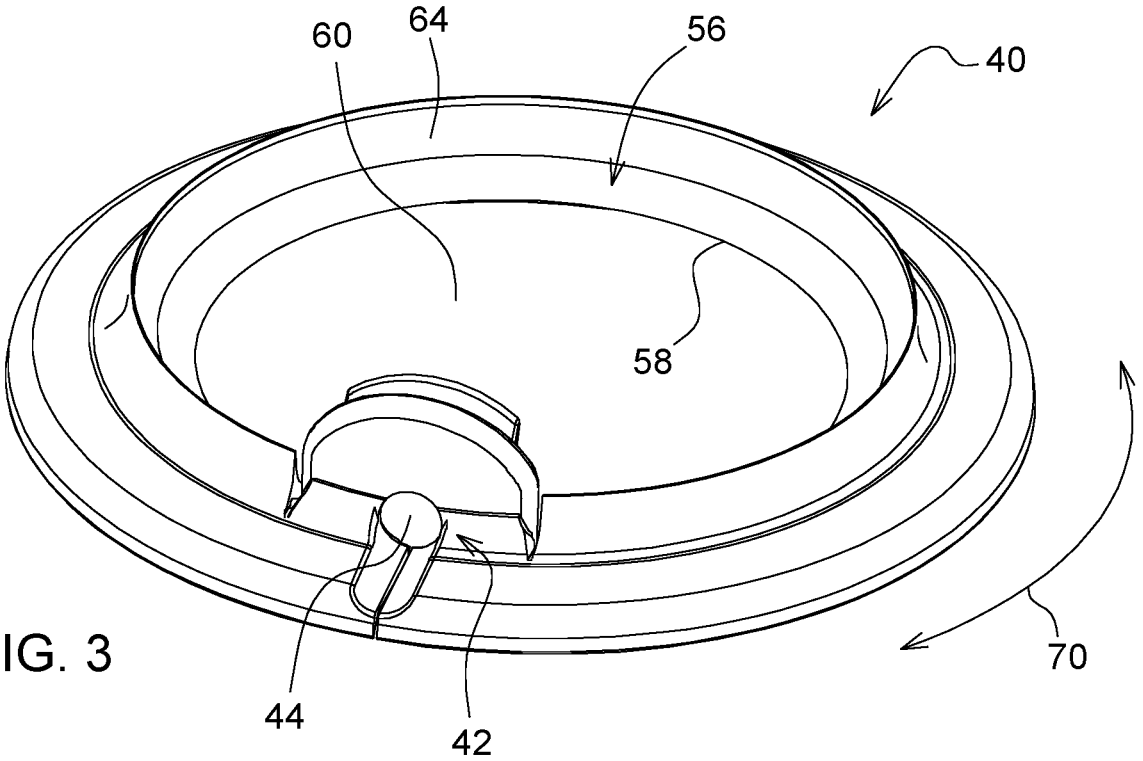
FIG. 3 shows a perspective illustration of the seal from FIG. 2.
Figure 4:
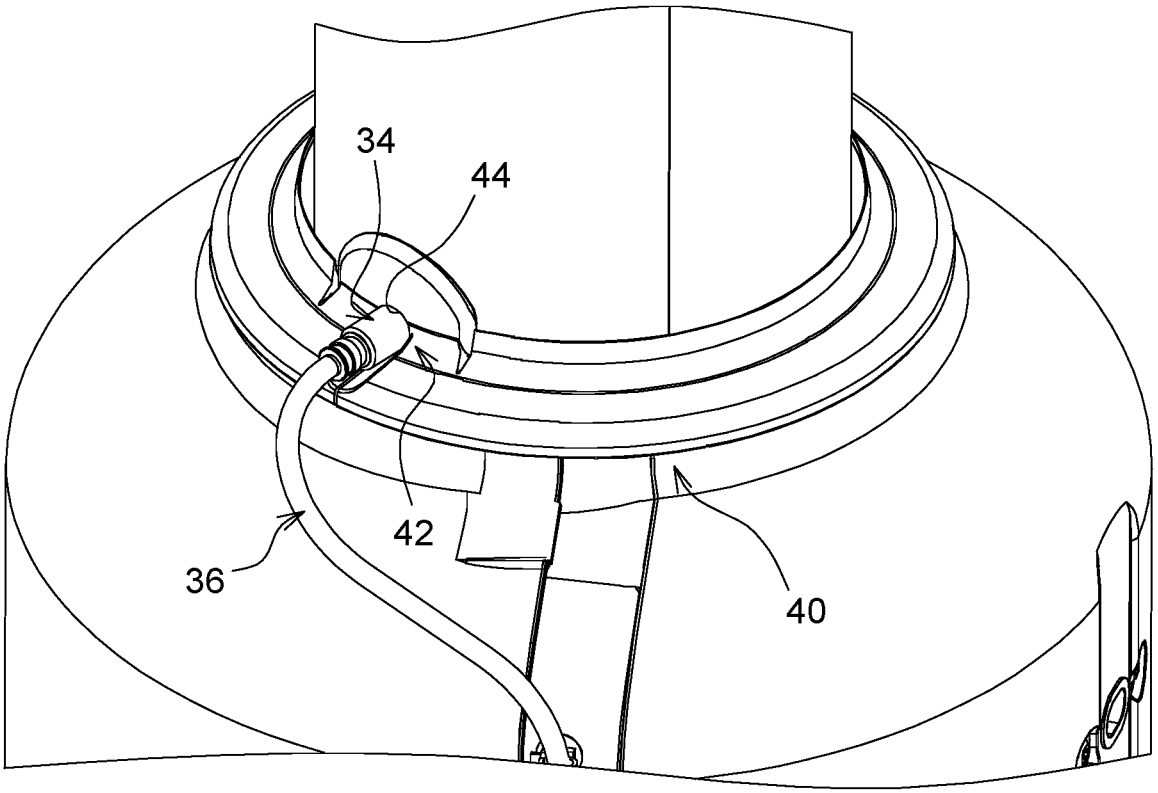
FIG. 4 shows a partial illustration of the seal from FIG. 3 with sensor unit arranged thereon.

FIG. 3 shows a receiving region 42 of the seal 40 with a radial passage opening 44. The receiving region 42 and its passage opening 44 serve to receive the $NO_x$ sensor 34 (FIG. 4).

Figure 5:
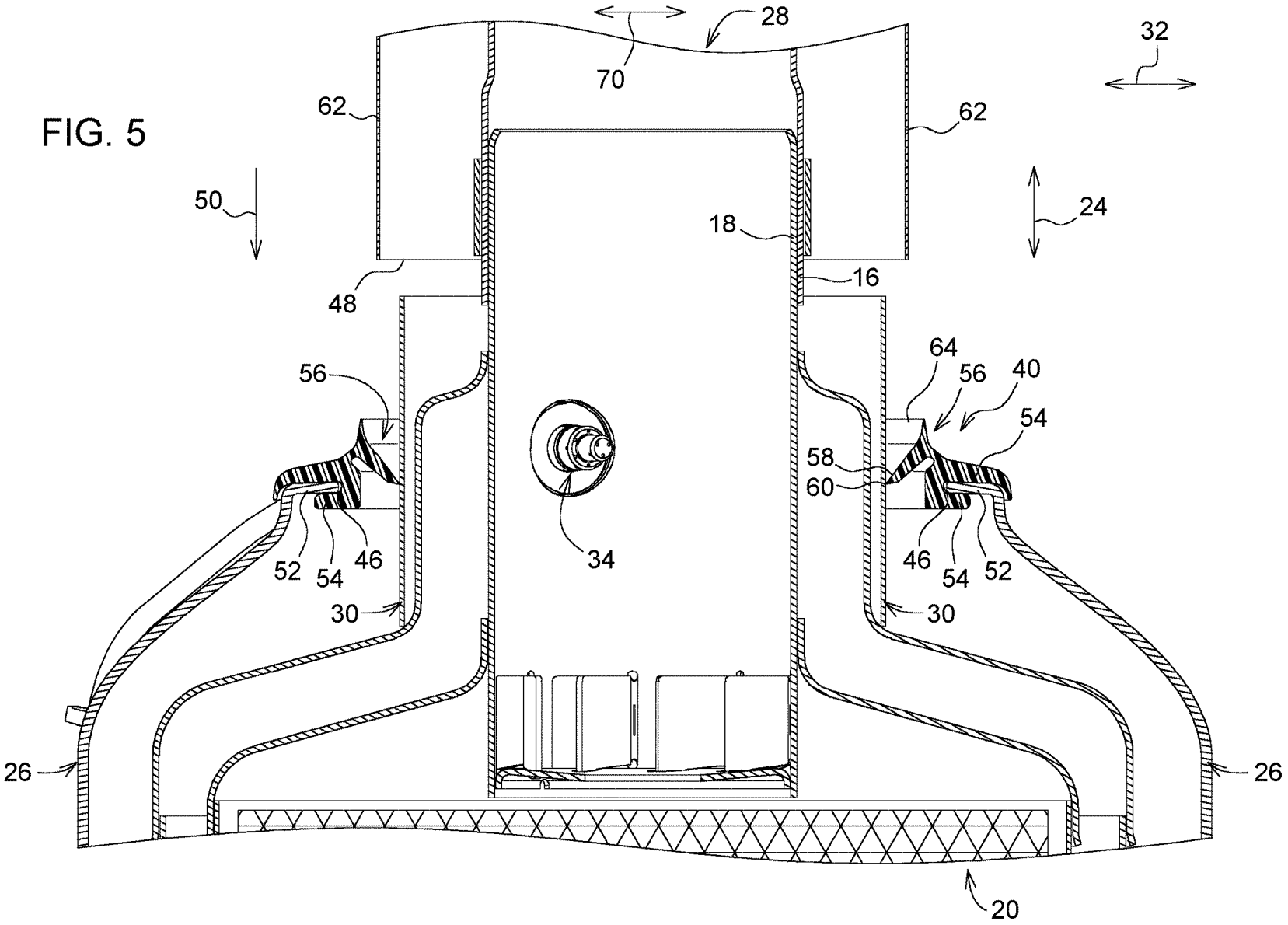
FIG. 5 shows a sectional side view of components of the exhaust system according to the disclosure with the seal from FIG. 2 in its starting position.

It is evident from FIG. 5 that the radial gap 38 is formed between an outlet opening 46 of the first shield part 26 and an inlet opening 48 of the second shield part 28, as soon as the shield part 28 has been brought up to the outlet opening 46 in an axial mounting direction 50. The outlet opening 46 is here delimited by a radially running shield edge 52 of the first shield part 26. Thus, it is evident that the outlet opening 46 is larger than the inlet opening 48, and after mounting of the second shield part 28, the radial gap 38 is formed between the two openings 46, 48 and sealed by the seal 40.

After mounting of the two shield parts 26, 28, the two openings 46, 48 need no longer necessarily be arranged in the same plane in the axial direction 24. Irrespective of the relative axial arrangement of the two openings 46, 48, the gap 38 formed between them is filled and sealed by a correspondingly shaped seal 40.

The seal 40 according to FIG. 5 is clamped to the radial shield edge 52 by two differently shaped clamping legs 54. The seal 40 has an elastic sealing lip 56 which is movable both axially and radially. A radially inner free lip end 58 of the sealing lip 56 delimits an axial seal opening 60 for receiving the second shield part 28.

In some embodiments, the entire seal 40 is made from an elastic material (e.g., silicone).

Figure 6:
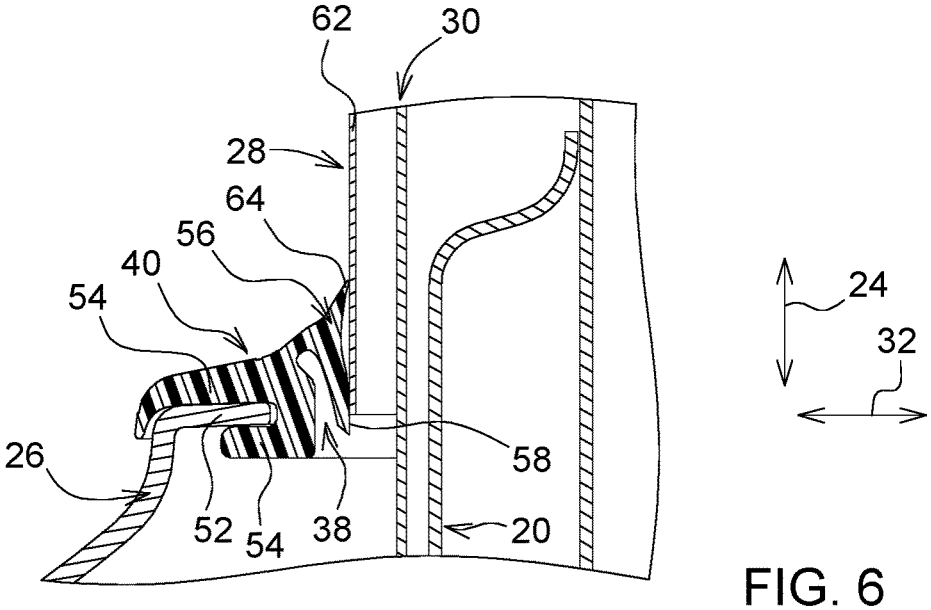
FIG. 6 shows a partial illustration of the side view from FIG. 5 with the seal in its sealing position.

In its starting position shown in FIG. 3 or FIG. 5, the seal opening 60 is smaller than a cross-section of an outer wall 62 of the second shield part 28. During assembly, the second shield part 28 is moved axially downward in the mounting direction 50, and thereby presses the radially inner free lip end 58 radially outward. At the sealing lip 56, this leads to a radially outer free lip end 64 being pivoted radially inward and lying sealingly against the outer wall 62 of the second shield part 28 (FIG. 6). The radially inner free lip end 58 also lies sealingly against the outer wall 62. Accordingly, a sealing position of the seal 40 is automatically achieved during mounting of the second shield part 28.

Figure 7:
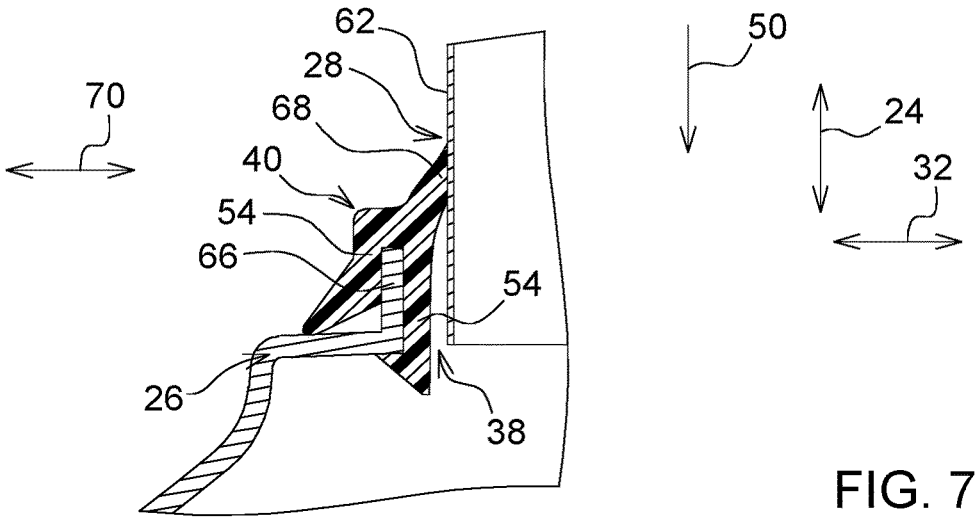
FIG. 7 shows a sectional side view around the region of the exhaust system from FIG. 6 in a further embodiment.

FIG. 7 shows a further embodiment of the first shield part 26 with a further embodiment of the seal 40. The first shield part 26 carries an axially running shield edge 66. The gap 38 may be sealed in a technically simple fashion for example if the seal 40, again configured as a closed ring seal along the circumferential direction 70, lies with a sealing lip 68 against the outer wall 62 of the second shield part 28. During a mounting movement of the second shield part 28 in the mounting direction 50, the two differently shaped clamping legs 54 of the seal 40 then automatically grip the region of the shield edge 66 in the manner of a latch. This automatically ensures a stable seat of the seal 40 on the first shield part 26, with the desired sealing of the radial gap 38.

Figure 8:
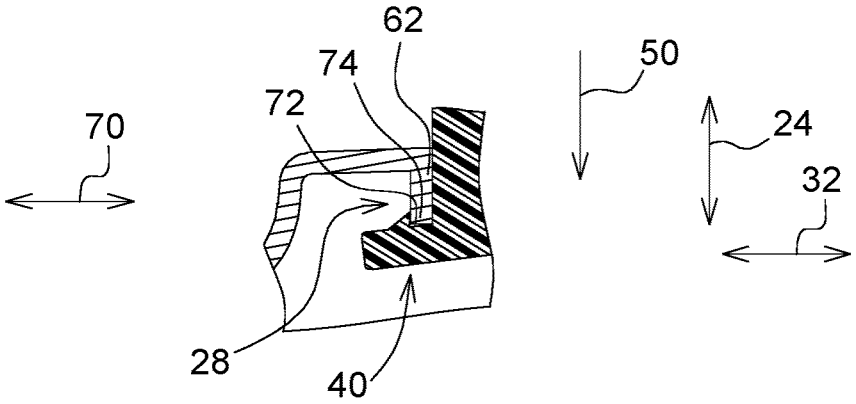
FIG. 8 shows a sectional side view of an extract of the seal in a further embodiment.

In a further embodiment, the seal 40 comprises a circumferential groove 72 running in the circumferential direction 70 and open axially towards the second shield part 28 (FIG. 8). This seal 40 can be already fixed to the first shield part 26 before the second shield part 28 is mounted. For assembly, the second shield part 28 is again moved in the mounting direction 50 until its axial free end 74 is received by the circumferential groove 72. This automatically ensures the desired sealing of the radial gap 38. The circumferential groove 72 may be provided on various embodiments of the seal 40.

Figure 9:
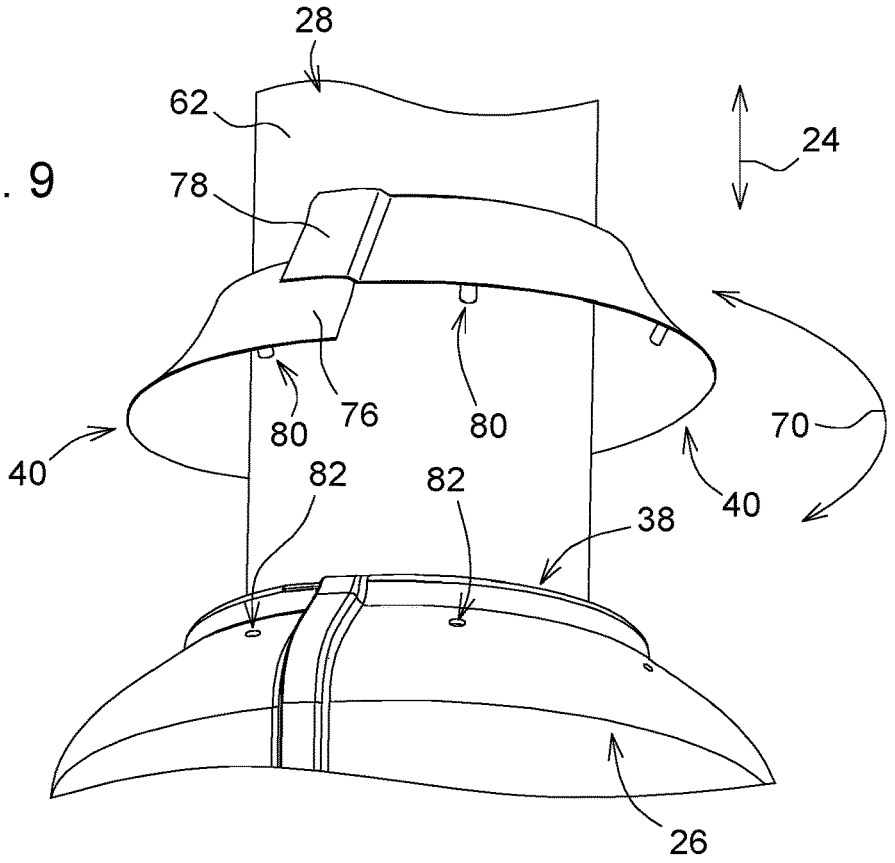
FIG. 9 shows a perspective illustration of the exhaust system according to the disclosure in the region of the first and second shield parts with the seal in a further embodiment.
Figure 10:
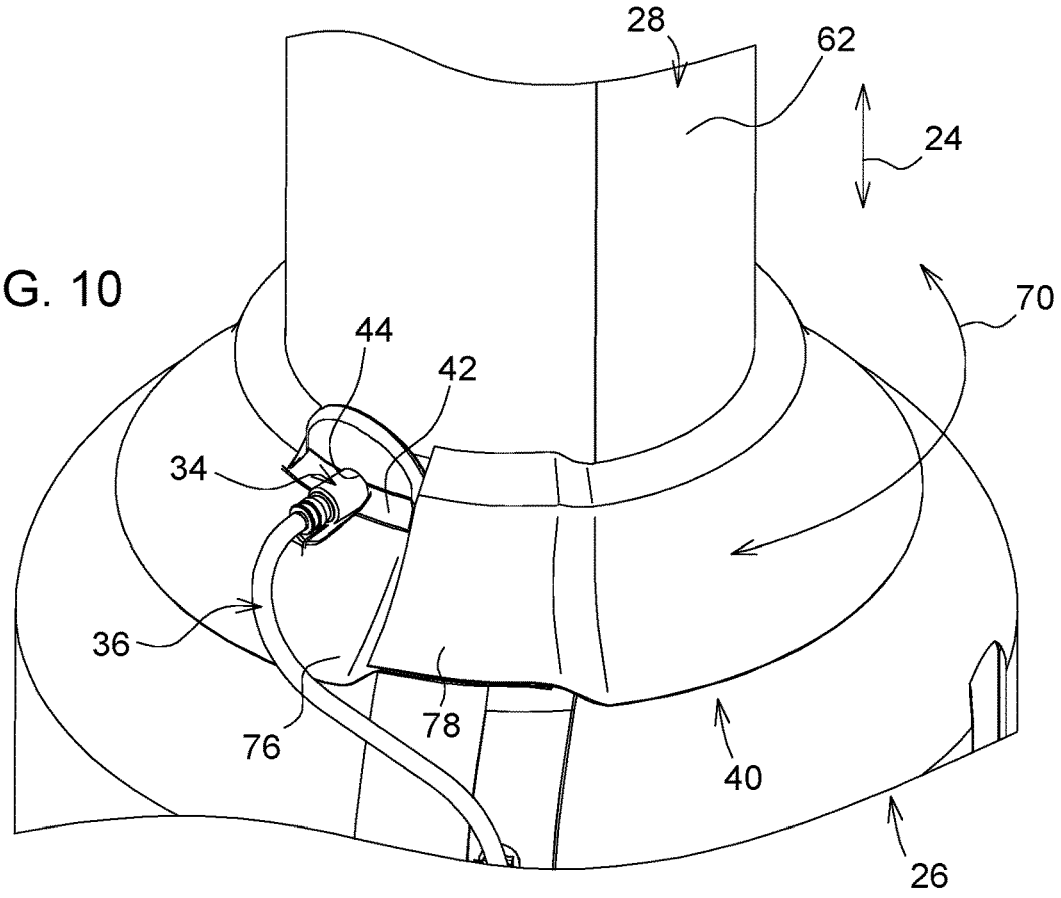
FIG. 10 shows a perspective illustration of the region of the exhaust system from FIG. 9 with the seal in its sealing position.

According to FIG. 9, in contrast to the embodiment of FIG. 3, the seal 40 is not formed closed in advance in the circumferential direction 70. Rather, in a starting position, the seal 40 in FIG. 9 has two free ends 76, 78 arranged in the circumferential direction 70, which are arranged adjoining or overlapping one another in the circumferential direction 70 when the seal 40 is in the sealing position shown in FIG. 10. In the circumferential direction 70, the seal 40 has several fixing protrusions 80 which cooperate with corresponding fixing recesses 82 on the first shield part 26. In this way, the seal 40 can be releasably fixed, e.g., latched, to the first shield part 26.

For a technically simple sealing of the radial gap 38 in the embodiment of FIG. 9, the seal 40 can be first releasably fixed to the first shield part 26 by fixing protrusions 80. Then the second shield part 28 can be moved in the mounting direction 50 until it cooperates with the seal 40. This cooperation can take place in the manner of the mounting shown in FIG. 8, i.e., the seal 40 according to FIG. 9 including the circumferential groove 72.

Details disclosed in the drawings are sometimes depicted schematically and/or not necessarily to scale.

The terminology used herein is for the purpose of describing example embodiments or implementations and is not intended to be limiting of the disclosure. As used herein, the singular forms "a," "an," and "the" are intended to include the plural forms as well, unless the context clearly indicates otherwise. It will be further understood that the any use of the terms "has," "includes," "comprises," or the like, in this specification, identifies the presence of stated features, integers, steps, operations, elements, and/or components, but does not preclude the presence or addition of one or more other features, integers, steps, operations, elements, components, and/or groups thereof.

Those having ordinary skill in the art will recognize that terms such as "above," "below," "upward," "downward," "top," "bottom," etc., are used descriptively for the Figures, and do not represent limitations on the scope of the present disclosure, as defined by the appended claims. Furthermore, the teachings may be described herein in terms of functional and/or logical block components or various processing steps, which may include any number of hardware, software, and/or firmware components configured to perform the specified functions.

Terms of degree, such as "generally," "substantially," or "approximately" are understood by those having ordinary skill in the art to refer to reasonable ranges outside of a given value or orientation, for example, general tolerances or positional relationships associated with manufacturing, assembly, and use of the described embodiments or implementations.

As used herein, "e.g.," is utilized to non-exhaustively list examples and carries the same meaning as alternative illustrative phrases such as "including," "including, but not limited to," and "including without limitation." Unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

While the above describes example embodiments or implementations of the present disclosure, these descriptions should not be viewed in a restrictive or limiting sense. Rather, there are several variations and modifications which may be made without departing from the scope of the appended claims.

What is claimed is:

1. An exhaust system with a multipiece heat shield for a work vehicle, comprising:

a first shield part which surrounds an aftertreatment unit for aftertreating exhaust gases, the first shield part extending in an axial direction; and a second shield part which surrounds an exhaust tailpipe with radial spacing between the second shield part and the exhaust tailpipe, the second shield part extending in the axial direction from the first shield part, wherein a radial gap between the first and second shield parts is sealed by a seal;

wherein the seal has a movable sealing lip which delimits an axial seal opening for receiving the second shield part, wherein in a starting position of the seal, the seal opening is smaller than a cross-section of an outer wall of the second shield part, and in a sealing position of the seal, the sealing lip lies against the outer wall of the second shield part.

2. The exhaust system of claim 1, wherein the radial gap is formed between an opening of the first shield part and an opening of the second shield part.

3. The exhaust system of claim 2, wherein the opening of the first shield part is larger than the opening of the second shield part.

4. The exhaust system of claim 1, wherein the seal is formed as a closed ring seal.

5. The exhaust system of claim 1, wherein the seal has a circumferential groove running in the circumferential direction of the heat shield and open axially towards the second shield part, for receiving an axial free end of the second shield part.

6. The exhaust system of claim 1, wherein the seal has a radial passage opening for receiving a sensor unit.

7. The exhaust system of claim 1, wherein the seal has a radial passage opening for receiving a $NO_x$ sensor unit.

8. A work vehicle including an exhaust system with a multipiece heat shield, comprising:

a first shield part which surrounds an aftertreatment unit for aftertreating exhaust gases, the first shield part extending in an axial direction; and a second shield part which surrounds an exhaust tailpipe with radial spacing between the second shield part and the exhaust tailpipe, the second shield part extending in the axial direction from the first shield part, wherein a radial gap between the first and second shield parts is sealed by a seal;

wherein the seal has a movable sealing lip which delimits an axial seal opening for receiving the second shield part, wherein in a starting position of the seal, the seal opening is smaller than a cross-section of an outer wall of the second shield part, and in a sealing position of the seal, the sealing lip lies against the outer wall of the second shield part.

9. The work vehicle of claim 8, wherein the radial gap is formed between an opening of the first shield part and an opening of the second shield part.

10. The work vehicle of claim 9, wherein the opening of the first shield part is larger than the opening of the second shield part.

11. The work vehicle of claim 8, wherein the seal is formed as a closed ring seal.

12. The work vehicle of claim 8, wherein the seal has a circumferential groove running in the circumferential direction of the heat shield and open axially towards the second shield part, for receiving an axial free end of the second shield part.

13. The work vehicle of claim 8, wherein the seal has a radial passage opening for receiving a sensor unit.

14. The work vehicle of claim 8, wherein the seal has a radial passage opening for receiving a $NO_x$ sensor unit.

15. An exhaust system with a multipiece heat shield for a work vehicle, comprising:

a first shield part which surrounds an aftertreatment unit for aftertreating exhaust gases, the first shield part extending in an axial direction; and a second shield part which surrounds an exhaust tailpipe with radial spacing between the second shield part and the exhaust tailpipe, the second shield part extending in the axial direction from the first shield part, wherein a radial gap between the first and second shield parts is sealed by a seal;

wherein the seal has a radial passage opening for receiving a sensor unit.

16. The exhaust system of claim 15, wherein the sensor unit is a $NO_x$ sensor unit.

* * * * *